US009987551B2

(12) United States Patent
Reece et al.

(10) Patent No.: US 9,987,551 B2
(45) Date of Patent: Jun. 5, 2018

(54) GEAR-BASED MECHANICAL PUZZLE

(71) Applicant: Stuart Patrick Alexander Reece, Innisfil (CA)

(72) Inventors: Stuart Patrick Alexander Reece, Innisfil (CA); Max Attilio Lupo, Barrie (CA)

( * ) Notice: Subject to any disclaimer, the term of this patent is extended or adjusted under 35 U.S.C. 154(b) by 0 days. days.

(21) Appl. No.: 15/591,313

(22) Filed: May 10, 2017

(65) Prior Publication Data

US 2017/0348590 A1 Dec. 7, 2017

Related U.S. Application Data

(60) Provisional application No. 62/345,239, filed on Jun. 3, 2016.

(51) Int. Cl.
*A63F 9/08* (2006.01)
*A63F 9/00* (2006.01)

(52) U.S. Cl.
CPC ..... *A63F 9/0819* (2013.01); *A63F 9/0073* (2013.01); *A63F 9/0865* (2013.01)

(58) Field of Classification Search
CPC ..... A63F 9/08; A63F 9/0811; A63F 9/0819; A63H 33/042
See application file for complete search history.

(56) References Cited

U.S. PATENT DOCUMENTS 2,095,046 A * 10/1937 Wilner ..... A63F 9/0819 273/153 R
3,134,593 A * 5/1964 Mouigal ..... A63F 9/0819 273/242
3,172,666 A * 3/1965 Ryan ..... G09B 25/02 273/243
3,193,293 A * 7/1965 Schaper ..... A63F 3/00261 273/153 R
3,417,996 A * 12/1968 Janiszewski ..... A63F 9/0819 273/157 R
4,058,317 A * 11/1977 McCarthy ..... A63F 3/00261 273/153 R
4,468,033 A * 8/1984 Minami ..... A63F 9/0823 273/117

(Continued)

FOREIGN PATENT DOCUMENTS

WO WO 2000/45913 * 8/2000
WO WO/2000/045913 8/2000

*Primary Examiner* — Steven Wong
(74) *Attorney, Agent, or Firm* — Chumak & Company LLP

(57) ABSTRACT

A multi-surfaced gear-based mechanical puzzle where the objective is to choose the proper sized gear and position on the surface(s) from available holes to have the gears align and rotate in unison on one or multiple surfaces, flat or curved, from a dictated start point to a dictated finish point.

Challenges such as going from "a" point to "c" point directly or additionally through way point "c" are outlined in an accompanying instruction booklet. Additionally, challenges may be presented as using a specific number or specific size of gears, for example, to achieve the objective.

In achieving the right combination of gear sizes and positions, the objective of going from one start point to a finish point by turning one gear to cause all other gears in the train to turn in unison can be accomplished.

The puzzle and components may be made from wood, plastic, metal or a composite material.

6 Claims, 9 Drawing Sheets

(56) References Cited

U.S. PATENT DOCUMENTS

| | | | | |
|---|---|---|---|---|
| 4,589,663 | A | 5/1986 | Doroslovac | |
| 4,869,506 | A * | 9/1989 | Wiggs | A63F 9/0819 273/155 |
| 5,100,142 | A * | 3/1992 | Cannata | A63F 9/0819 273/153 S |
| 5,135,225 | A * | 8/1992 | Pszotka | A63F 9/0823 273/153 S |
| 6,361,048 | B1 * | 3/2002 | Lynn | A63F 3/00006 273/243 |
| 7,108,263 | B2 | 9/2006 | Cabeza et al. | |
| 7,125,015 | B2 | 10/2006 | Hoberman et al. | |
| D538,346 | S * | 3/2007 | Rowe | D19/59 |
| 7,309,064 | B1 * | 12/2007 | Engel | A63F 9/0819 273/153 S |
| 7,604,234 | B2 | 10/2009 | Cutrofello | |
| 2002/0065016 | A1 * | 5/2002 | Huang | A63H 33/042 446/103 |
| 2005/0227573 | A1 * | 10/2005 | Lin | A63F 9/06 446/85 |
| 2007/0200292 | A1 * | 8/2007 | Nesis | A63F 9/0803 273/153 S |
| 2011/0009028 | A1 * | 1/2011 | Gurdin | A63F 9/0819 446/132 |
| 2011/0133406 | A1 * | 6/2011 | Chiu | A63F 9/0819 273/276 |

* cited by examiner

GEAR-BASED MECHANICAL PUZZLE

FIELD OF INVENTION

The present invention relates to a puzzle.

BACKGROUND

Puzzles are designed to stimulate intellectual curiosity by providing a challenge to the player. Usually an objective is defined and the player must solve the puzzle to achieve that objective. A puzzle will commonly present a number of apparent solutions to the objective, but only one, or at least a limited number, of solutions are correct.

Puzzles may also provide different challenges for different skill levels and ideally will allow a number of different objectives to be defined using the same playing pieces.

It is an object of the present invention to provide a puzzle that meets these requirements.

BRIEF DESCRIPTION OF THE INVENTION

A puzzle has one or more playing surfaces and a number of different sized drive members which can be rotatably mounted on the surface(s) at different locations. The mounting is preferably by a fixed peg that can be inserted into any of a multitude of mounting holes allowing for drive member placement options. The puzzle can provide a multitude of goals at different levels of difficulty outlining start and end points on the surface(s) for a given challenge level. The drive members must be placed into relative alignment with each other with multiple combinations of sizes and routes available to achieve the different goals of going from one point to another, sometimes with additional requirements of route or a specific selection of sizes. There are markings on the surface(s) to identify different points which coincide with the goals outlined in the accompanying instructions as start or end or thru points. In the preferred embodiment, the playing surfaces are arranged as an open cube and the multitude of drive members of differing sizes can be stored within the interior of the cube.

BRIEF DESCRIPTION OF DRAWINGS

For a more detailed description and a better understanding of the invention, reference should be made to the drawings wherein.

DETAILED DESCRIPTION

Figure 1:
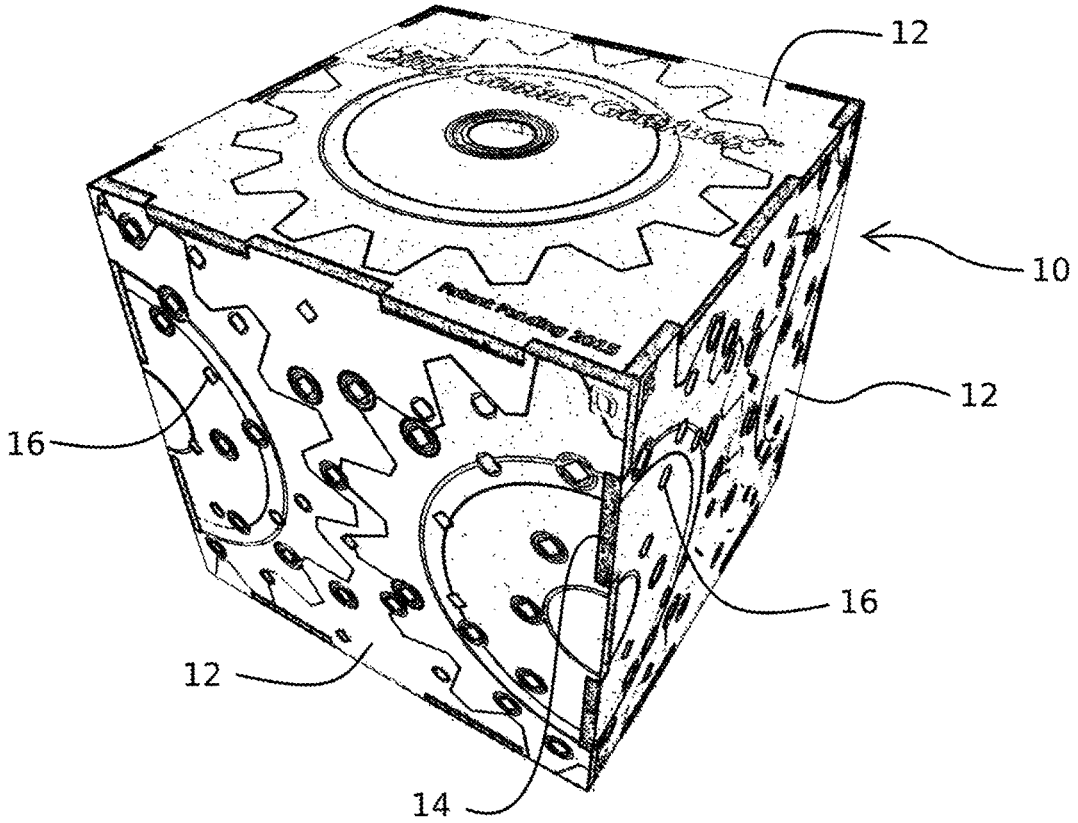
FIG. 1 shows a top perspective view of a puzzle with playing pieces stored.
Figure 2:
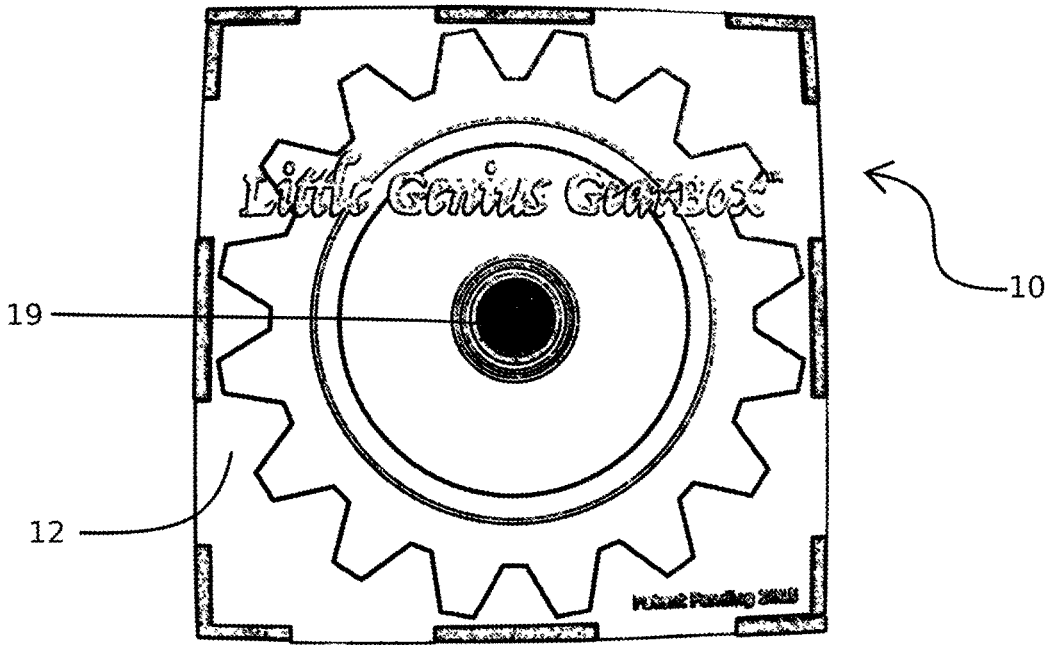
FIG. 2 shows a top view of a puzzle in FIG. 2 with the top closed with markings
Figure 3:
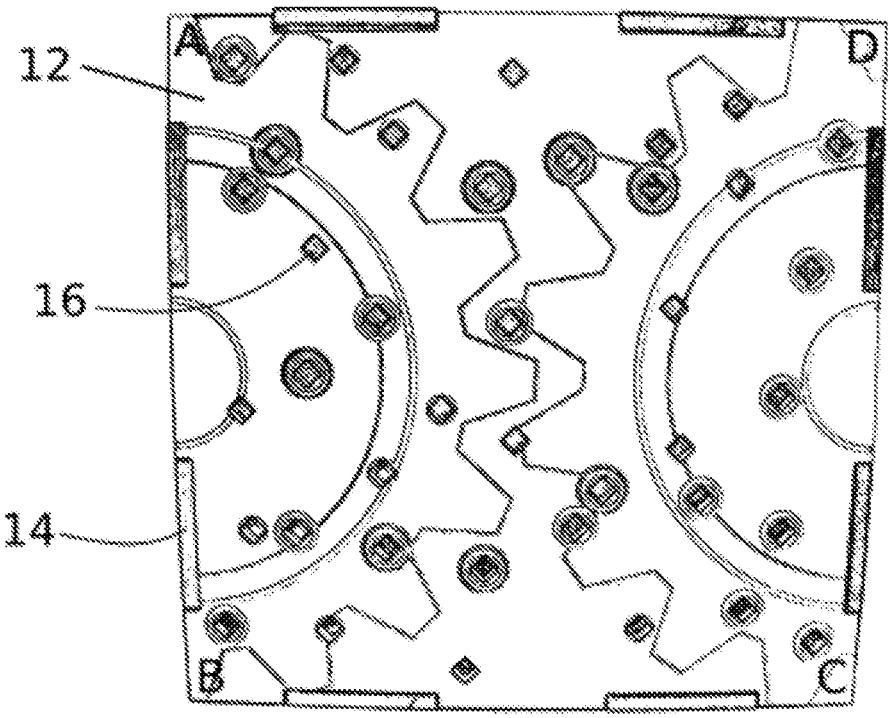
FIG. 3 is a front perspective of the puzzle of FIG. 1 with the top closed.

Referring firstly to FIG. 1 a puzzle, 10, has six inter connected playing surfaces 12 that are arranged as sides of a cube. The edges 14 of each of the playing surfaces 12 are casselated so that the edges are interdigitated and interlock to form the cube. Each of the playing surfaces 12 is generally planar and has a number of holes 16 distributed over the face playing surface 12.

Figure 4:
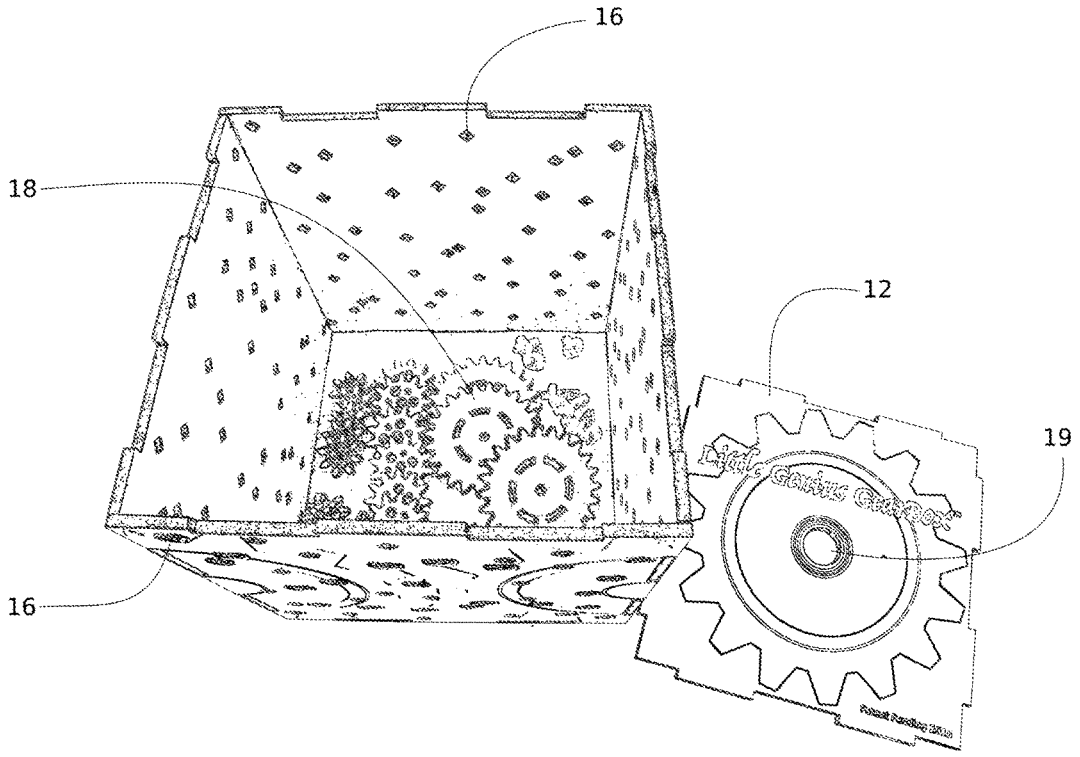
FIG. 4 shows a top view of a puzzle in FIG. 1 showing the playing pieces stored inside the puzzle with the top lid removed and sitting adjacent.

The top playing surface 12 sits upon the four sides and can be lifted out via the finger hole 19 as can be best seen in FIG. 4 to allow access to the interior of the cube. As shown in FIG. 4, the interior of the cube is used to store playing pieces which are in the form of gears 18. The gears 18 are of different sizes or diameters and may be arranged with different tooth sizes or different colors to provide additional complexity to the problem set by the puzzle 10.

Figure 6:
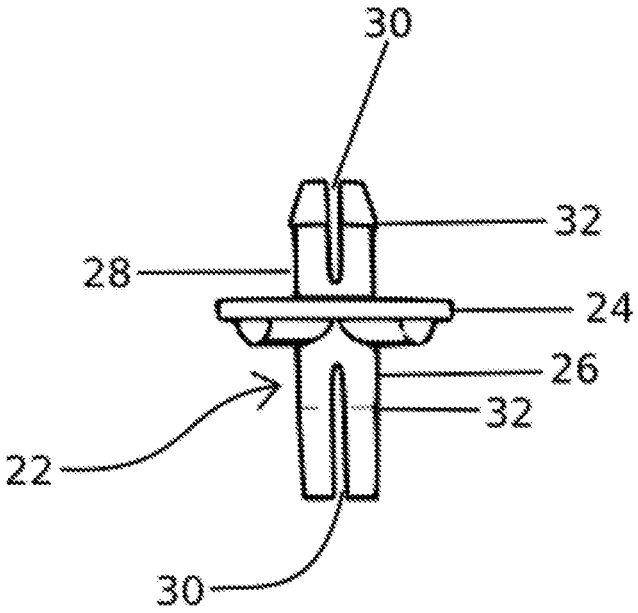
FIG. 6 shows a side view of a peg, used to secure the gears to a playing surface.

Each of the gears 18 has a central aperture 20 receive a peg 22 illustrated in FIG. 6. The peg 22 has a central waist 24 from which upper shanks 28 and lower shanks 26 extend. Each of the shanks 26, 28 is slightly flared outwardly and has an elongate slot 30 extending towards the central waist 24. The extremities of the shanks are chamfered to provide inclined shoulders 32.

The lower shank 26 is dimensioned to be a push fit into the holes 16 with the slot 30 providing flexibility to allow the peg 22 to be inserted into or removed from the holes 16. The upper shank 28 is similarly dimensioned to be a push fit into the central aperture 20 of the gears 18 with the slot 30 providing flexibility to allow the upper shank 28 to be inserted into or removed from the central aperture 20.

With the peg 22 inserted into the hole 16 and a gear 18 mounted on the upper shank 28, the gear 18 is free to rotate relative to the playing surface 12. Each of the gears 18 has the same diameter aperture 20 allowing the pegs 22 to be used interchangeably with the different gears and mounted in any of the holes 16 on any of the playing surfaces 12.

Figure 5:
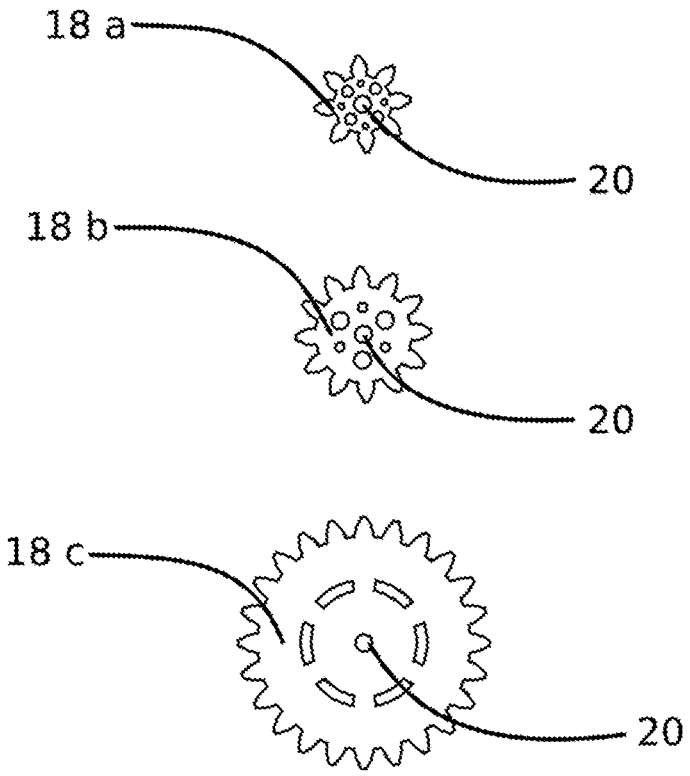
FIG. 5 shows three different sized gears utilized as playing members.

The holes 16 are spaced about the playing surface so that the distance between a given pair of holes 16 corresponds to the sum of the radius of two gears. For example, referring to FIG. 5, if the gear indicated 18*a* has a radius "a" and the gear indicated 18*b* has a radius "b", then a pair of holes 16 will be spaced apart a distance a+b. Holes 16 are also formed adjacent the edges of each of the playing surfaces 12 and spaced from the edges by the radius of respective ones of the gears 18. In this way, a gear mounted on a peg 22 in one of the holes 16 adjacent to the edges 14 will overlap the edge to allow engagement of a gear similarly mounted on an adjacent playing surface 12. As shown the recesses are not formed with equal, uniform space between the recesses and across the playing surfaces.

Figure 7:
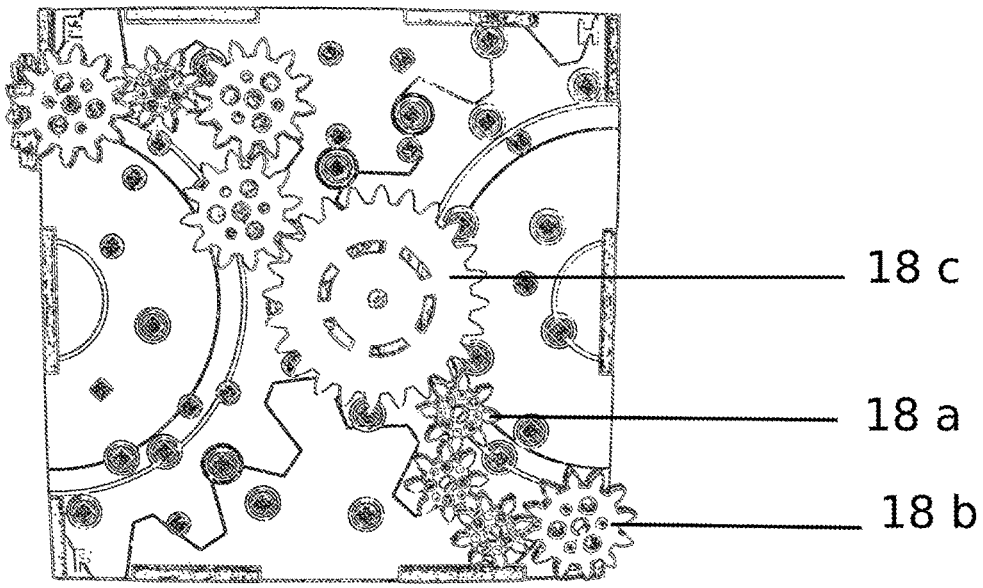
FIG. 7 shows a back view of the puzzle of FIG. 1 having playing pieces deployed.

The puzzle may be used in a number of different configurations, either with a single playing surface 12 or with a plurality of playing surfaces connected to one another. In its simplest form, the challenge set by the puzzle one is to provide a train of gears 18 that extend along one of the paths delineated on a playing surface 12. The player therefore has to select the combination of gears 18 that will allow pegs 22 to be inserted in holes 16 disposed along a selected one of the paths and ensure that adjacent gears engage to transmit rotation from one gear to the next. For example, as can be seen in FIG. 7, the challenge is to follow a path from one corner to the diagonally opposite corner. The array of holes 16 requires a train comprising a medium gear 18*b*; a small gear 18*a*; a pair of medium gears 18*b*; a large gear 18*c*; three small gears 18*a* and a medium gear 18*b* to extend from one corner to the other. A different sequence of gears will result in overlap or spacing between the gears so a complete, functional gear train is not attained.

Spurious holes 16 may be included along the path to add to the complexity, and of course these spurious holes 16 may be legitimate holes for alternative paths or configurations. It is also not necessary to define the problem as following a defined path, but might be posed as extending between set points using at least one large gear 18*c*; or requiring the first and last gears to rotate in opposite directions, or requiring the train to pass through a particular point on the playing surface 12.

The provision of the holes along each edge 14 allows multiple playing surfaces 12 to be utilized. A pair of playing surfaces 12 can be arranged edge to edge in a common plane and the gears 18 positioned to extend across the edges. In this way the problem posed might be to extend diagonally across each of the surfaces 12 with the gears meshing, or to cross the edges 14 at a defined point.

Figure 8:
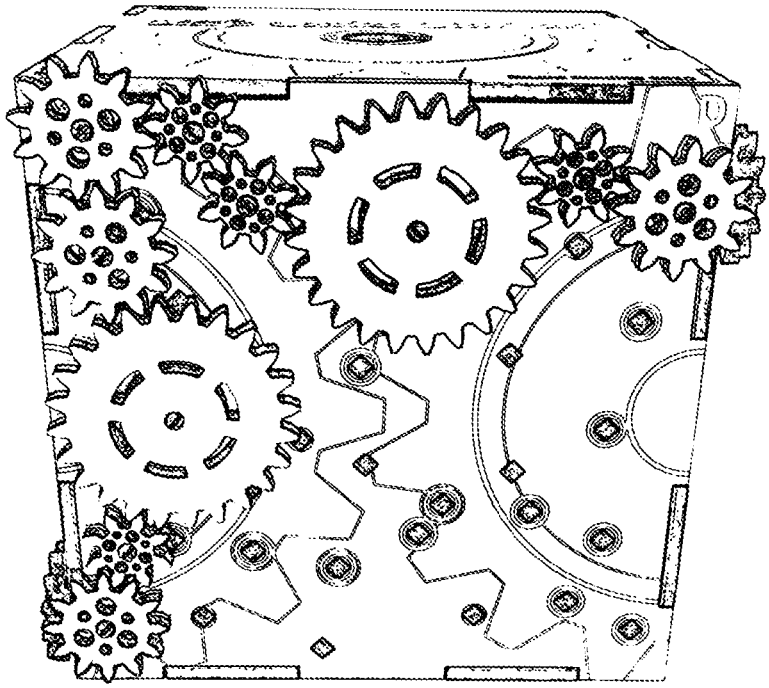
FIG. 8 shows a front view of a puzzle similar to FIG. 7.
Figure 9:
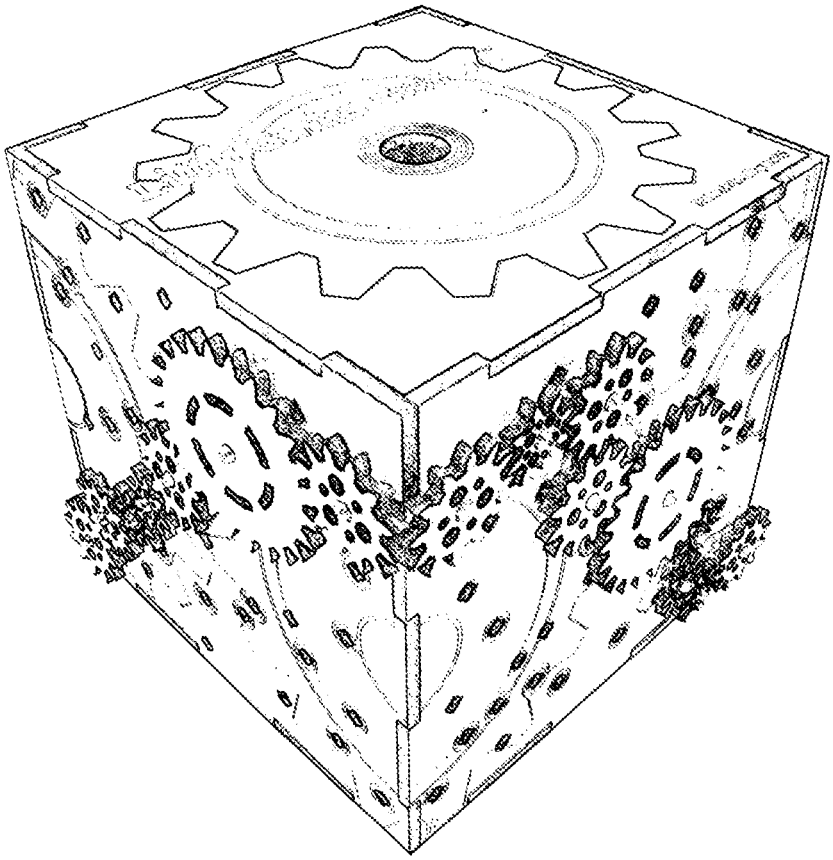
FIG. 9 is a perspective view of the playing surfaces like shown in FIGS. 7 and 8.

As is shown in FIGS. 7 to 9, the configuration of the playing surfaces 12 allows them to be arranged in a cube and for the gears to extend around the corner of the cube formed by the edges 14. The holes 16 adjacent the edges 14 allow the gear 18 to project beyond the edge 14 sufficient to engage in teeth of a gear 18 carried by the adjacent playing surface 12. Rotation is thus transmitted around the corner and the gear train may continue across the next playing surface 12. Ultimately, the gear train may extend around further corners and across several of the surfaces 12 to return to the starting point to provide a circumnavigation of the cube.

After use, the gears 18 and pegs 22 can be removed and stored within the cube for future use. The playing surfaces 12 may be formed from plastic or other sheet material including wood, and the pegs are conveniently molded from a resilient plastics material.

In general, the gear size selection and placement are up to the user insofar as the gears may be mounted on the surface via the available holes. The arrangement of the gears may take on any shape or form from a linear arrangement wherein several gears are in a line, to a curved or angular arrangement wherein the gears form a curved line or cross surfaces at angles or traverse a curved surface.

The puzzle can contain numerous challenges where the player must choose the correct gear size combination and the gear placement providing a route to connect a dictated starting point to a dictated end point. It utilizes gears which must be aligned such that the gears turn in unison and span from the dictated start point to the dictated finish point.

The playing surface is shown as planar, but it could be curved so as to form a globe or barrel with holes disposed to permit a combination of gears to align across different surfaces or over a curved surface thereby continuing the transfer of energy from gear to gear.

Solutions to different puzzles is facilitated by position markings on the surfaces 12 which correspond to schemes set out in an instructional booklet which outlines challenges to be attempted with differing and increasing levels of difficulty.

A multi-surfaced gear-based mechanical puzzle where the objective is to choose the proper sized gear and position on the surface(s) from available holes to have the gears align and rotate in unison on one or multiple surfaces, flat or curved, from a dictated start point to a dictated finish point.

Challenges such as going from "a" point to "c" point directly or additionally through way point "c" are outlined in an accompanying instruction booklet. Additionally, challenges may be presented as using a specific number or specific size of gears, for example, to achieve the objective.

In achieving the right combination of gear sizes and positions, the objective of going from one start point to a finish point by turning one gear to cause all other gears in the train to turn in unison can be accomplished.

The puzzle and components may be made from wood, plastic, metal or a composite material.

The embodiments above have been described using gears 18 with teeth but it will be appreciated that other forms of drive members, such as discs, could be used with frictional engagement between the peripheral surface of the discs providing drive from one to the other.

What is claimed is:

1. A puzzle comprising three or more generally planar playing surfaces that are angularly disposed relative to one another, with recesses formed in the playing surfaces, wherein the recesses are not formed with equal, uniform space between the recesses across the playing surfaces, and a number of different sized gear-shaped drive members which can be rotatably mounted by insertion into the recesses on the playing surface at different locations, wherein the gear-shaped drive members may be placed into relative alignment with each other with multiple combinations of differently sized, gear-shaped drive members and routes available on the three or more playing surfaces to achieve a specific challenge of driving the gear-shaped drive members from a designated starting point to a designated end point along the three or more generally planar playing surfaces.

2. A puzzle according to claim 1 wherein markings are provided on said playing surfaces to identify different points.

3. A puzzle according to claim 1 comprising four playing surfaces and a bottom surface wherein the playing surfaces and the bottom surface are arranged as an open cube and the multitude of different sized gear-shaped drive members can be stored within the interior of the cube.

4. A puzzle according to claim 1 wherein each of said gear shaped drive members is mounted on a peg that can be inserted into any of the recesses allowing for gear-shaped drive member placement options.

5. A puzzle according to claim 1, wherein the gear-shaped drive members are positioned to overlap an edge of a playing surface and engage another gear-shaped drive member mounted on an adjacent playing surface.

6. A puzzle according to claim 5 wherein said gear-shaped drive members are angularly disposed relative to one another.

* * * * *